US005328281A

United States Patent [19]

Narita et al.

[11] Patent Number: 5,328,281

[45] Date of Patent: Jul. 12, 1994

[54] RECORDING MEDIUM FEED MECHANISM FOR A PRINTER AND METHOD OF MEDIUM FEED CONTROL

[75] Inventors: Hiroshi Narita; Naoki Asai; Yoshikazu Itoh, all of Suwa, Japan

[73] Assignee: Seiko Epson Corporation, Tokyo, Japan

[21] Appl. No.: 947,229

[22] Filed: Sep. 18, 1992

Related U.S. Application Data

[63] Continuation-in-part of Ser. No. 507,319, Apr. 10, 1990, Pat. No. 5,149,217.

[30] Foreign Application Priority Data

Jun. 26, 1992 [JP] Japan ..... 4-169320

[51] Int. Cl.[5] ..... B41J 11/48

[52] U.S. Cl. ..... 400/605; 400/636; 400/708

[58] Field of Search ..... 400/596, 599, 605, 630, 400/636, 636.1, 706, 707.1, 708

[56] References Cited

U.S. PATENT DOCUMENTS

| | | | |
|---|---|---|---|
| 4,442,769 | 4/1984 | Kallin | 400/630 |
| 4,795,282 | 1/1989 | Bradam | 400/605 |
| 4,988,226 | 1/1991 | Ito | 400/605 |
| 5,061,095 | 10/1991 | Asai et al. | 400/605 |
| 5,120,145 | 6/1992 | Kawahara | 400/636 |

FOREIGN PATENT DOCUMENTS

| | | | |
|---|---|---|---|
| 96884 | 6/1982 | Japan | 400/630 |
| 248671 | 10/1987 | Japan | 400/636 |
| 6166 | 1/1990 | Japan | 400/708 |

*Primary Examiner*—David A. Wiecking
*Attorney, Agent, or Firm*—Eric B. Janofsky

[57] ABSTRACT

A recording medium feed mechanism for a printer includes first, second and third transport sections in the printer along a medium pathway wherein the first transport section is disposed at the insertion point of the recording medium into the printer, the second transport section is disposed immediately before the printer section relative to the direction of transport of the recording medium and the third transport section is disposed immediately after the printer section relative to the direction of transport of the recording medium. A single drive source is adapted for driving in common drive rollers at all three transport sections. First, second and third opening/closing mechanisms are incorporated respectively at the first, second and third transport sections to provide closure and medium engagement and its transport when the medium is present at a particular transport section and to provide its opening when the medium is not present or no longer present at a particular transport section. A method of control is provided for determining when a recording medium is present or absent from a particular transport section utilizing a recording medium stop member and detector in the medium pathway from which the location of the leading or trailing edges of the recording medium can be ascertained. Enhancement in accurate control is achieved in medium transport permitting the extension of data printing in medium margins adjacent the leading and trailing edges of the medium.

10 Claims, 9 Drawing Sheets

RECORDING MEDIUM FEED MECHANISM FOR A PRINTER AND METHOD OF MEDIUM FEED CONTROL

CROSS REFERENCE TO RELATED APPLICATION

This application is a continuation-in-part of patent application Ser. No. 07/507,319, filed Apr. 10, 1990, now U.S. Pat. No. 5,149,217 issued Sep. 22, 1992.

BACKGROUND OF THE INVENTION

This invention relates generally to a medium feed mechanism for a printer and, in particular, to a medium feed mechanism for a so called point-of-sales (POS) printer having a means for transport of a recording medium, such as, a slip sheet or paper, or validation card, through the printer in micro fed steps such as, in increments of less than 1 mm, permitting printing directly to the edges of the recording medium, i.e., printing from the leading edge to the trailing edge of the recording medium.

POS printers are micro printers capable of handling various types of recording medium, such as, a sheet or slip medium, card or validation medium or a rolled medium. They are also referred to as slip printers. The POS market requires that different kinds of recording medium be employed with a single printer as housed in a modern day electronic cash register. However, to incorporate several capabilities into a single slip printer is difficult because of a large number of moving mechanisms required in a single printer to provide for the capability of printing on two or more different kinds of recording media. Further, the bulkiness of the printer structure is large in order to provide for several drive sources in the printer to drive several different transport means positioned along a medium pathway within the printer. U.S. Pat. No. 5,061,095 exemplifies in prior art FIGS. 11 through 14 some of these problems concerning slip printers of the prior art.

U.S. Pat. No. 5,061,095 discloses an improvement over these prior art printers wherein, as shown in FIG. 6(*a*), a single power source 9 is employed for the printer to operate two pairs of spaced apart, transport rollers 5, 6 and 7, 8 to feed a recording medium 12, such as, a slip sheet, through the printer and past print head 1 for printing. Engagement of respective pressure rollers 6 and 8 in contact with their respective drive rollers 5 and 7 is brought about by operation of the respective solenoids 28 and 18. When the trailing edge of slip medium 12 in the medium pathway has almost passed or has just passed the position of drive roller 7, medium 12 is engaged between rollers 5, 6 for continued incremental feeding past print section 1 so that roller 8 may, therefore, be disengaged from drive roller 7 by release of the plunger of solenoid 18. However, as the trailing edge of slip medium 12 passes from between rollers 5, 6, there is a large bottom portion of slip medium 12 in which no printing can be accomplished because there is no longer any transport rollers in the printer operative for continued engagement of medium 12. The length of medium 12 upon which printing cannot be successfully accomplished is approximately the distance between rollers 5, 6 and the print head 1*a* of printer section 1. As a result, not all of the slip medium printable surface can be reliably utilized for printing, which is a problem when additional data is desired to printed on the same standardized slip medium or printing is to be accomplished on a nonstandard size slip medium.

Moreover, as the slip medium is transported adjacent to printer section 1, the leading edge of the print medium, at this point, is an unsupported, extended free end so that, while the medium is held in a firm grip by rollers 5, 6, it is still difficult to print on the medium surface while achieving the highest attainable print quality since the extended free end of the medium is not under any direct control of the incremental drive movement applied to the medium. Furthermore, since, at this point, there is only a single pair of rollers 5, 6 directly controlling the transport of the slip medium through the printer, changes in the alignment and transport direction, as well as variances in the particular incremental movement, may occur to the medium as the medium is transported past the print head. Such variances are due, in part, to mechanical idiosyncrasies of the paired rollers 5, 6 and their support mechanism. Thus, the printed indicia on the slip medium may not always be accurately aligned in consecutive rows of printed data.

It is an object of this invention to provide a compact, simple structured medium feed mechanism for a printer capable of transporting a recording medium through the printer section of a printer with incremental feed precision and permitting the printer section to print data on the recording medium starting immediately adjacent to the transported leading edge of the medium and concluding at the immediately adjacent portion to the transported trailing edge so that virtually all of the surface of the medium may be successfully utilized for carrying printed data.

It another object of this invention to provide for accurate control in the transport of a recording medium through a printer by means of selective operation of a series of recording medium transport sections wherein such a transport section is position both at inlet side and the outlet side of the printer section of the printer.

It is a further object of this invention to provide a printer with several transport sections driven in common by a single power source to provide the transport of the recording medium through the printer wherein an operating mechanism at least at one transport section is activated or inactivated by means of operation of operating mechanisms at two other transport sections.

SUMMARY OF THE INVENTION

According to this invention, a plurality of recording medium feed mechanisms are provided at different locations in a printer along a recording medium pathway and are all driven by a single step motor through speed reduction means and are selectively capable of feeding several different types of mediums, e.g., a slip medium, a card medium or a rolled medium, i.e., feeding each such medium independently of the another presented via different inlets to the printer for each different type of medium. The step motor functions as the sole driving source for a multiple medium handling type printer thereby providing a less expensive printer which is capable of incrementally feeding multiple different kinds of medium types in the same printer wherein printing can be accomplished from the very top edge to the very bottom edge of the fed medium due to the particular locations of the recording medium feed mechanisms in the printer. In particular, a slip or card medium is engaged by the medium feed mechanisms positioned in transport sections on adjacent sides (inlet and outlet sides) of the printer section of the printer so that printing from the portion adjacent to the leading edge of the transported recording medium to the portion adjacent to the trailing edge of the transported recording medium can be accomplished without leaving any significant medium margin.

The present invention utilizes first, second and third recording medium transport sections along the medium path through the printer wherein two of the transport sections are disposed on adjacent sides of the printer section, i.e., one transport section is disposed immediately before the printer section and the other transport section is disposed immediately after the printer section. Further, first, second and third recording medium drive rollers are respectively disposed in the first, second and third recording medium transport sections wherein all of these drive rollers are driven from a common source with means to engage and disengage respective auxiliary contact pressure rollers at each transport sections thereby forming respective first, second and third transport section opening/closing mechanisms. These opening/closing mechanisms permit the separation or disengagement and contacting or engagement of the roller pairs in the recording medium pathway for purposes of engaging and driving the recording medium when present in the path between a roller pair as well as disengaging and opening the medium pathway for the subsequent passage of another recording medium of the same type, such as, a slip medium, or the passage of a different kind of medium, such as a validation medium.

This invention further includes the provision wherein a third opening/closing mechanism added to a third transport section in a printer is activated or inactivated by means of operation of the opening/closing mechanisms at first and second transport sections of the printer so that an additional transport section in the printer can be realized without adding a full compliment of additional parts necessary for operating the additional opening/closing mechanism thereby realizing a savings in costs as well as not requiring an increase in the size of the printer through the inclusion in the printer of an additional transport section.

This invention also includes the provision of a method for controlling the transport of a recording medium through a printer by detecting the insertion of the medium in the printer when the leading edge of medium is inserted into the printer inlet to a predetermined point, and thereafter engaging the medium with a first transport section for transport of the recording medium to a point wherein printing can commence at the portion adjacent to the leading edge of the recording medium; determining whether or not the recording medium has passed a point wherein the medium can be engaged by a second transport section positioned immediately prior to the printing section of the printer and engaging the medium at the second transport section as printing continues; determining whether or not the recording medium has passed a point wherein the medium can be engaged by a third transport section positioned immediately after to the printing section of the printer and engaging the medium at the third transport section as printing continues on the recording medium. In the case of engagement of the leading edge of the medium by the second or the third transport section, the first or the second transport section, respectively, may also still be in engagement with the trailing portion of the medium. As a result, accurate transport of the medium is maintained by two sets of spaced transport means as well as accurate aligned hand-off by one transport section to the next adjacent transport section is achieved thereby resulting in maintained high quality printing, including accurate printing of data on portions of the medium immediately adjacent to the leading edge and trailing edge of the recording medium wherein, at this point in time, the second transport section and the third transport section, respectively, are the sole drive source responsible for the transport of the medium in the printer.

Thus, this invention provides for a POS printer that more accurately transports a recording medium through the printer a while reducing the amount of leading edge and trailing edge unprinted margins (i.e., the amount of white space between such an edge and the first row of printed data) of the slip or card medium thereby permitting more printing data on the currently employed or standardized slip and card mediums as well as readily adapting the printing to the medium edges in the case of nonstandard or new types of slip and card mediums having, for example, a nonstandard length size.

Other objects and attainments together with a fuller understanding of the invention will become apparent and appreciated by referring to the following description and claims taken in conjunction with the accompanying drawings.

DESCRIPTION OF THE PREFERRED EMBODIMENTS

Figure 1:
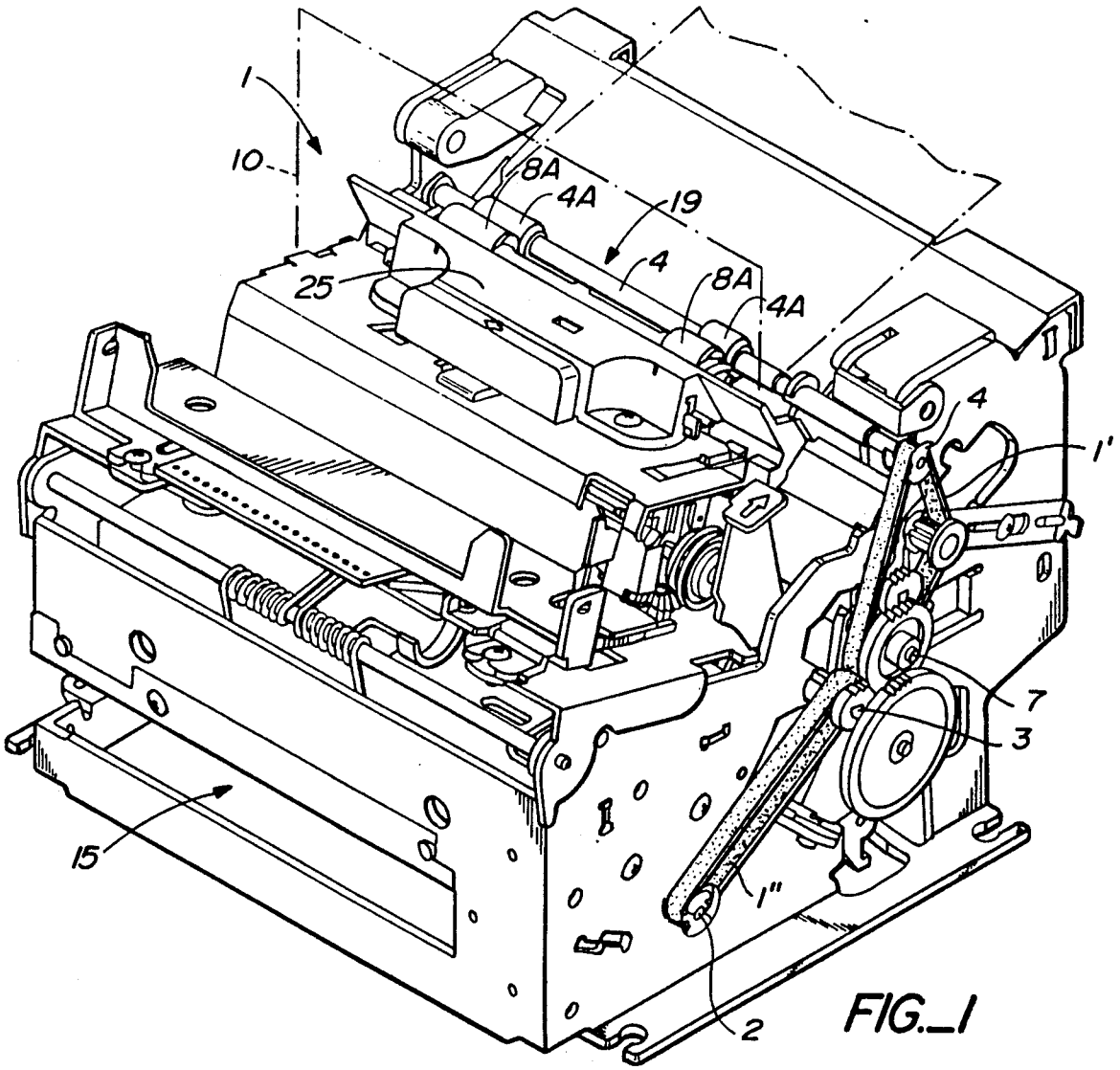
FIG. 1 is a perspective view of a printer comprising an embodiment of this invention.

Reference is now made to FIGS. 1–7 for the purpose of describing the structure of the printer comprising this invention. Printer 1 shown in FIG. 1 is capable of handling a slip medium or card medium or rolled medium utilizing a single drive means in the form of step motor 1A. A typical application for printer 1 is in an electronic calculator or electronic cash register.

Figure 2:
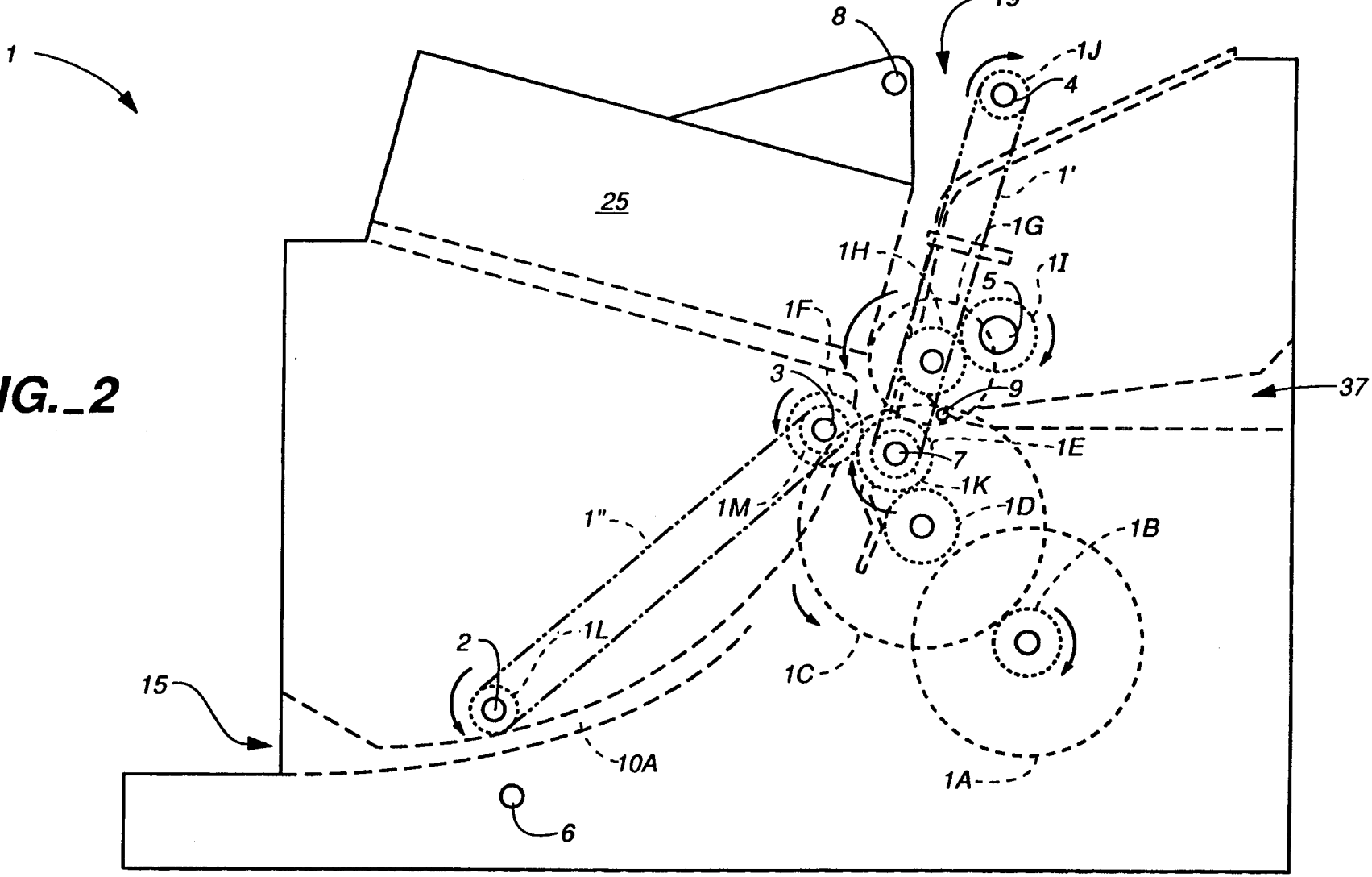
FIG. 2 is a schematic side representation taken from the left side of the printer shown in FIG. 1 illustrating in phantom the driving arrangement for a plurality of medium feed mechanisms driven by a single step motor.

As shown in FIG. 2, the rotational power of step motor 1A is transmitted to a plurality of drive shafts 2, 3, 4 and 5 via a gear mechanism or train comprising a combination of gears 1B–1I and belts 1' and 1". The drive shaft of motor 1A includes gear 1B which drives larger gear 1C for purposes of speed reduction. Gear 1C includes smaller gear 1D which in turn drives gear 1E secured to drive shaft 7. Gear 1E also is coupled to drive gear 1F secured to card medium drive shaft 3 and large gear 1G. Large gear 1G includes smaller gear 1H which in turn drives gear 1H secured to rolled medium drive shaft 5. Card output drive shaft 4 is driven by belt 1' coupled between pulley 1J fixed on shaft 4 and pulley 1K. Drive shaft 2 is driven by belt 1" coupled between pulley 1L fixed to shaft 2 and pulley 1M fixed to shaft 3.

Figure 3:
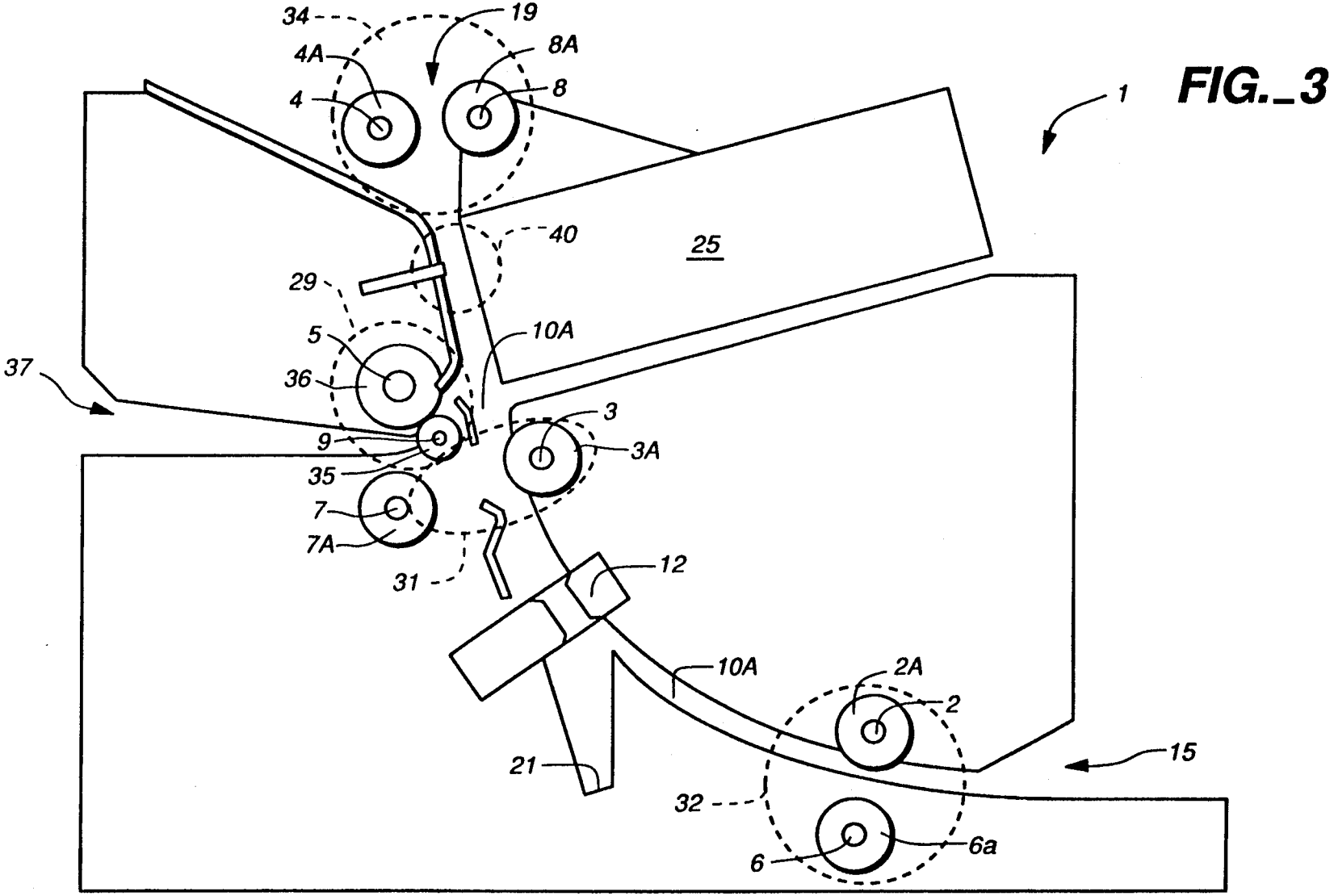
FIG. 3 is another schematic cross sectional, right side elevation of the printer shown in FIG. 1 focusing on four separate regions of medium feed mechanisms provided in the printer of FIG. 1.
Figure 4:
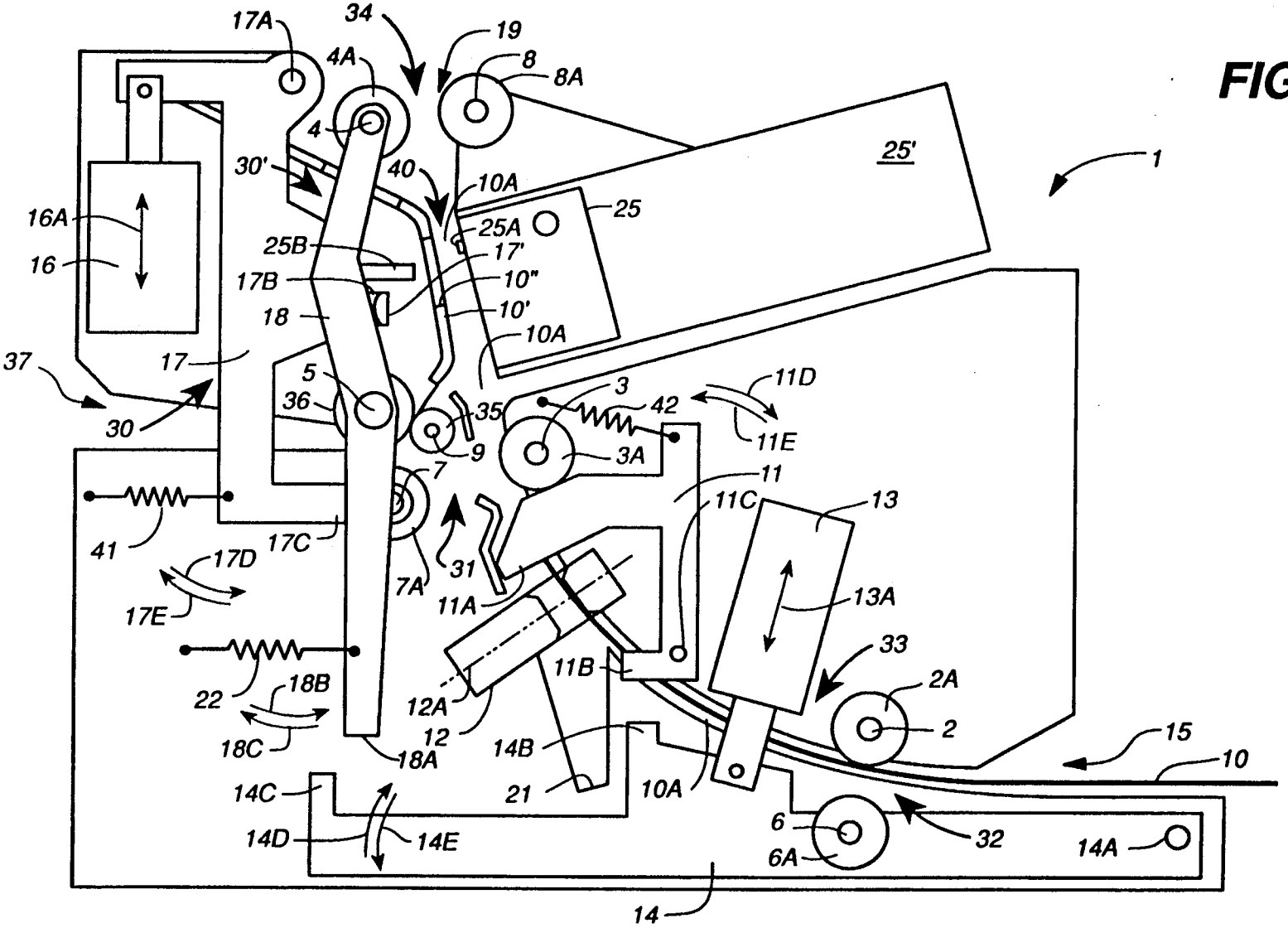
FIG. 4 is a schematic cross sectional elevation of the printer shown in FIG. 1 for the purpose of illustrating a first in a series of figures illustrating the operation of the recording medium feed mechanism according to this invention.
Figure 6:
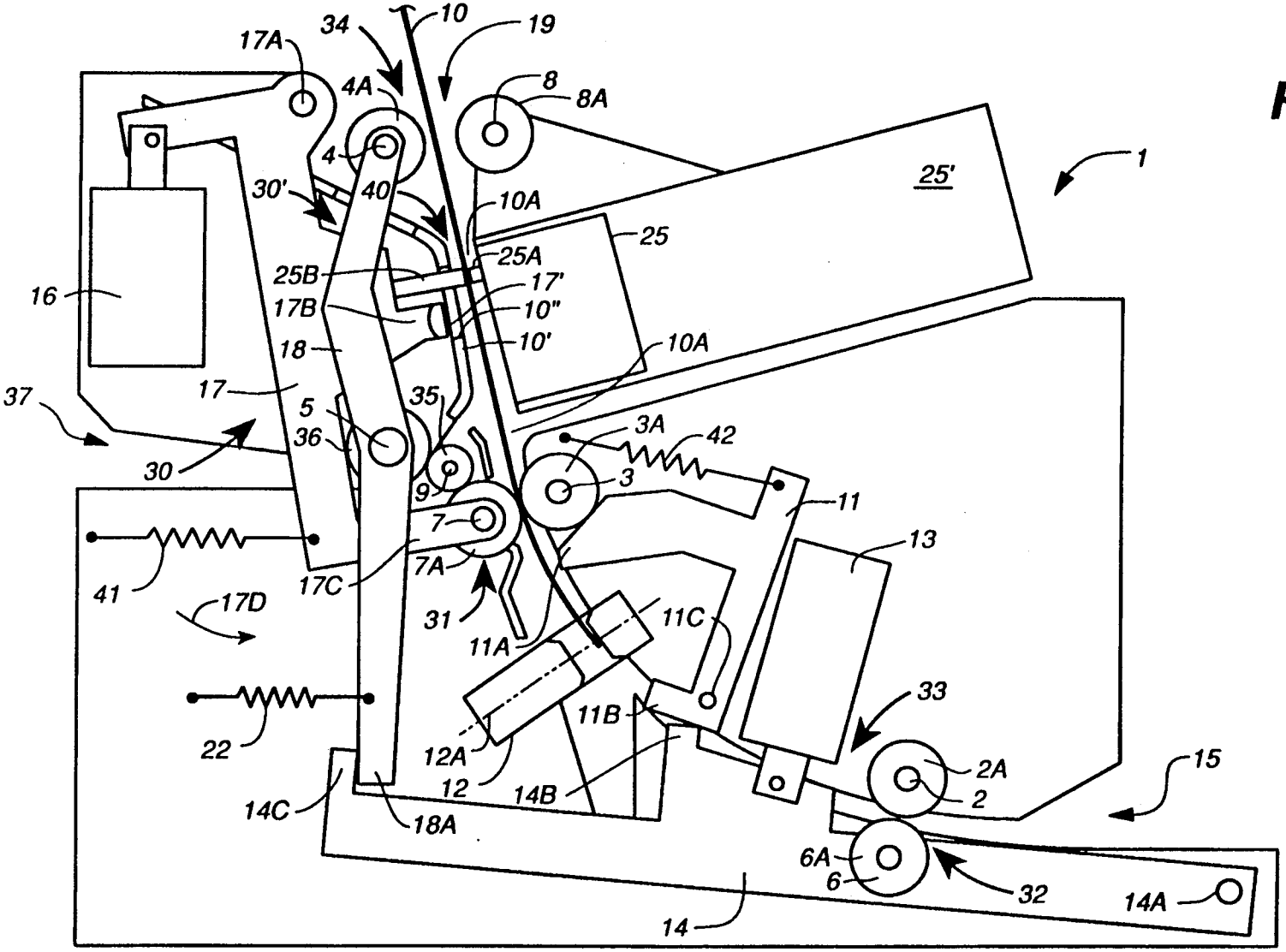
FIG. 6 is a schematic cross sectional elevation of the printer shown in FIG. 1 for the purpose of illustrating a third in a series of figures illustrating the operation of the recording medium feed mechanism according to this invention.

As shown in FIG. 3, each drive shaft 2, 3, 4, and 5 has a corresponding drive roller 2A, 3A, 4A and 36 secured to rotate therewith, except that drive roller 36 is designed to intermittently engage with drive shaft 5. Further, each drive shaft 2, 3, 4 and 5 respectively have a corresponding associated medium shaft 6, 7, 8, and 9. However, it should be noted that associated medium shafts 6, 7, 8 and 9 are support shafts for corresponding idler type support or pressure rollers 6A, 7A, 8A and 35, which are each rotatably mounted on their shafts. In this connection, rollers 35 and 36 are in continuous engagement with each other, as depicted in FIG. 3, and drive roller 36 can be intermittently driven by a clutch mechanism disclosed in detail in U.S. Pat. No. 5,149,217, which patent is incorporated herein by reference thereto. However, in the case of drive roller 3A and idler roller 7A, these rollers may be disengaged, as shown in FIG. 4, or may be engaged, as shown in FIG. 6, by an opening/closing mechanism 30. In this connection, one end of drive shafts 3 and 7 are fixed relative to each other so that their respective gears 1F and 1K are always in engaged relationship with each other, as depicted in FIG. 2. However, the other ends of shaft 7 may be separated from shaft 3 by means of the movement of opening/closing mechanism 30 via operation of solenoid 16, as depicted in FIGS. 4 and 6, which will be explained in greater detail later.

As shown in FIG. 3, different drive shafts 2-5 are positioned in different regions along medium pathway 10A of printer 1, and these regions of the different drive shafts are referred to as recording medium transport sections indicated by encircling dotted lines 29, 31, 32, and 34. Printer section 40 is positioned between transport sections 31 and 34. Recording medium transport section 32 includes drive shaft 2 and its associated medium feed roller 2A; recording medium transport section 31 includes drive shaft 3 and its associated card feed roller 3A; recording medium transport section 34 includes drive shaft 4 and its associated card medium output feed roller 4A; and recording medium transport section 29 includes drive shaft 5 and its associated medium support or pressure roller 35. Slip medium feed roller 2A is positioned near slip insertion inlet 15, card medium feed roller 4A is positioned near card insertion inlet 19, and rolled medium support roller 35 is positioned near rolled medium insertion inlet 37. It should be noted that inlet 19 functions also as an outlet for output drive from printer 1 all three types of medium: slip or sheet, card, and rolled. The feeding of a slip medium 10 through printer 1 along medium pathway 10A is performed by the sequential operation of medium drive shaft 2 via drive roller 2A, medium drive shaft 3 via drive roller 3A and medium output drive shaft 4 via drive roller 4A.

This invention has particular reference to the three transport sections 31, 32 and 34 and the opening/closing mechanisms to engage and disengage the paired rollers at recording medium transport sections 31, 32 and 34 and are referred to as first transport section opening/-closing mechanism 33 and second transport section opening/closing mechanism 30, which latter mechanism is also responsible for concurrently opening and closing of printer section 40 as well as the third transport section 34 as well as has a direct influence on the opening/closing function at the third transport section 34, all of which will be explained further on in greater detail.

Printer mechanism 25 at the printer section 40 provides means by which three different kinds of mediums, a sheet or slip type of medium, a card medium, or a rolled medium may be printed upon at printer section 40 as the selected medium is fed upwardly in pathway 10A and out of inlet 19.

Reference is now made to the structure and operation of printer 1 relative to the feeding of a slip medium 10, such as a sheet or slip of paper; a card medium 20, such as a ridged paper card; and a rolled medium 36, such as, a paper roll for cash register or calculator data printing. particular reference is made to the transport of a slip medium.

With reference to FIG. 4, printer section 40 includes print head 25 having a plurality of printing elements 25A arranged in a horizontal row for printing on a recording medium positioned between elements 25A and an opposing platen 25B. Also, facing print head 25 is recording medium guide 10' which includes an opening 10' for permitting the passage therethrough of platen 25B when platen 25B is brought toward printing elements 25A to form a printing gap therebetween. The print head 25 and platen 25B are the principal components of printer section 40. The ribbon cassette 25' houses the ink ribbon (not shown) for printing elements 25A.

Recording medium pressure roller 7A at the second recording medium transport section 31, disposed opposite to drive roller 3A, is rotatably supported on the end of lever arm 17C. Platen 25B is also fixed to the same lever 17. Lever 17 is configured to be rotated in a direction indicated by arrow 17D by means of the retraction of the plunger of solenoid 16 about pivot point 17A, opposite to the applied force of spring 41, to bring platen 25A in opposite, opposed relation with printing elements 25A forming a predetermined print gap therebetween, which is based upon the thickness of the recording medium, thereby permitting the passage of recording medium 10 through the printing gap under a tight tolerance. In this connection, the end point of the rotational movement of lever 17 in the direction indicated by arrow 17D is determined by pressure contact of roller 7A with drive roller 3A. The separation of this contact is determined by thickness of the recording medium position between rollers 3A and 7A. Therefore, the thickness of the recording medium present between these two closed rollers determines automatically the spacing of the printing gap formed between printing elements 25A and platen 25B. In other words, the printing gap size at printing section 40 varies according to the thickness of the recording medium so that the printing gap is automatically set by the gagging accomplished with the use rollers 3A and 7A. Platen 25B, lever 17 with arm extensions 17B and 17C together with pressure roller 7A and solenoid 16 comprise the principal components of the combination printer section and second transport section opening/closing mechanism 30.

In further explanation of FIG. 4, first recording medium transport section 32 comprises pressure roller 6A, medium drive roller 2A, control lever 14 and solenoid 13. Solenoid 13 and lever 14 together with pressure roller 6A comprise the first transport section opening/-closing mechanism 33. Pressure roller 6A is rotatably supported on shaft 8 of lever 14 and drive roller 2A is secured to drive shaft 2. Medium pressure roller 6A on lever 14 is adapted, therefore, to be held away from pathway 10A, in a direction indicated by arrow 14E, by the plunger of solenoid 13 to permit the free insertion of the leading edge of a recording medium into medium pathway inlet 15. Slip medium 10 is positioned into inlet 15 to pass through recording medium transport section 32, as depicted in FIG. 4. When slip medium 10 is inserted into inlet 15 and extended up pathway 10A, the forward end of medium 10 will eventually engage toe 11A of stop member 11, already positioned in pathway 10A, thereby limiting the further progression of medium 10 in the pathway. The obstruction of pathway 10A by stop member 11 is maintained by the applied force of spring 42. As will be evident later in conjunction with FIG. 9, stop member 11 also functions as a gauge indicating the beginning print position for printing data on the leading edge of slip medium 10.

Figure 5:
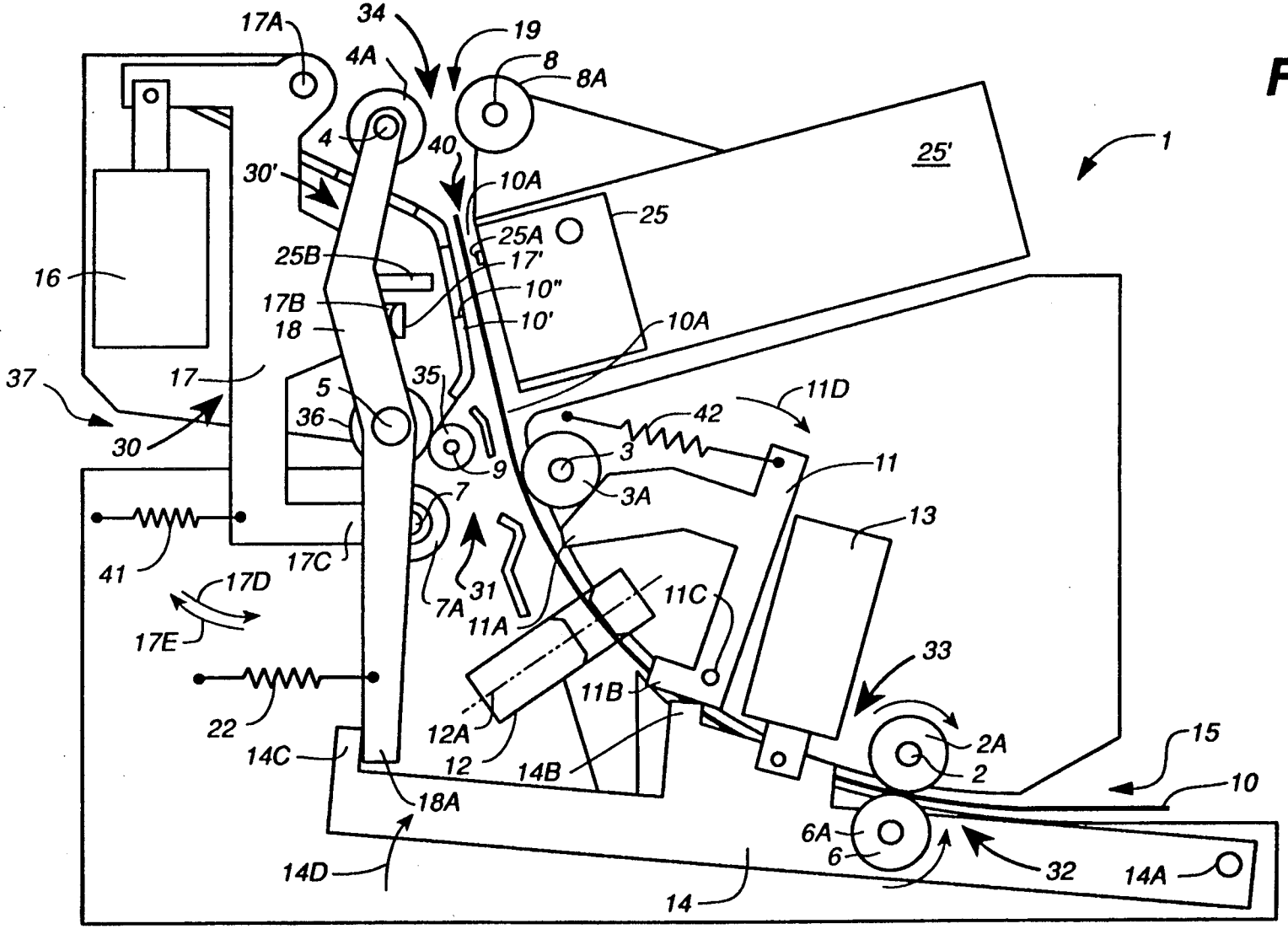
FIG. 5 is a schematic cross sectional elevation of the printer shown in FIG. 1 for the purpose of illustrating a second in a series of figures illustrating the operation of the recording medium feed mechanism according to this invention.

Medium sensor 12, mounted in pathway 10A just before stop member toe 11A will detect the presence of medium 10 when the forward end of medium 10 engages stop member toe 11A. A signal is supplied from medium sensor 12 to the printer control system indicating that slip medium 10 is present at position 12A of the sensor and, as a result, solenoid 13 will be activated. The plunger of solenoid 13 is connected to support lever 14 which rotates lever 14 about point 14A. When solenoid 13 is actuated to rotate lever 14 in a clockwise direction, as indicated by arrow 14D, roller 6A is brought into pressure engagement with roller 2A, closing mechanism 33, with medium 10 positioned between rollers 2A and 6A, as seen in FIG. 5. Also, at the same time, upward extending toe 14B of lever 14 engages stop member toe 11B causing lever 11 to also rotate about point 11C in a clockwise direction 11D and moving stop member toe 11A out of the path of slip medium 10, also illustrated in FIG. 5. Further, it should be noted that toe 14C of lever 14 also catches the end 18A of lever 18, the function of which will be explained in detail later. Because the rotation of stop member 11 and the engagement of rollers 2A and 6A, slip medium 10 is now enabled for transport further along medium pathway 10A under the driving power of drive roller 2A via drive shaft 2 and step motor 1A. This will advance slip medium 10 into the second recording medium transport section 31.

Second transport section 31 comprises drive roller 3A driven by shaft 3 and control lever 17 including pressure roller 7A rotatably supported on shaft 7 supported on extension arm 17C and solenoid 16. Solenoid 16 and lever 17 together with pressure roller 7A and platen 25B comprise the combination printer section and second transport section opening/closing mechanism 30. Lever 17 is held in a biased condition in the direction indicated by arrow 17E by means of the applied force of spring 41. Actuation of solenoid 16 will cause the retraction of the plunger of solenoid 16 and the rotation of lever 17 in the direction indicated by arrow 17D against the force of spring 41.

The spatial relationship between medium drive shaft 2 and medium drive shaft 3 is fixed so that, when slip medium 10 passes beyond the second transport section 31 by a predetermined amount, a signal is supplied by the printer control system to solenoid 16. As shown in FIGS. 4 and 5, the plunger of solenoid 16 is connected to control lever 17 which is pivotally supported at point 17A. As previously indicated, lever 17 also includes, along its forward edge, extended platen 25B, contact member 17' on extension arm 17B and pressure roller 7A on extension arm 17C. The outer end of extension arm 17B includes contact member 17' for the purpose of engaging the forward edge of lever 18, as illustrated in FIG. 4. As previously indicated, when the plunger of solenoid 16 is actuated, lever 17 is caused to rotate in a counter clockwise direction indicated by arrow 17D about point 17A, as seen in FIG. 6. As a result, pressure roller 7A is brought into engagement with drive roller 3A with slip medium 10 engaged therebetween to be positively driven upward along medium pathway 10A.

Reference is now made to lever 18 which is mounted on drive shaft 5 approximately at center point of the lever 18. Lever 18 is rotatably mounted on shaft 15 and can be rotated in the direction of either of arrows 18B and 18C. The upper end of lever 18 supports drive roller 4A fixed to rotatable drive shaft 4. The lower end 18A of lever 18 is adapted to be engaged by the toe 14C of lever 14. Lever 18 is held in a biased condition in the direction indicated by arrow 18C by means of the applied force of spring 22. Lever 18, drive roller 4A and pressure roller 8A, rotatably mounted on shaft 8, comprise third recording medium transport section 34. Levers 17 and 18 together with solenoid 16 comprise the third transport section opening/closing mechanism 30'.

Furthermore, levers 17 and 18 are interengaged with one another by means of contact member 17' contacting the forward edge of lever 18 so that lever 17 can restrict the movement of lever 18 in the direction indicated by arrow 18C, which is principally caused by the retention force of spring 22. Thus, when solenoid 16 is inactivated, spring 41 will cause rotation of lever 17 in the direction of arrow 17E which, in turn, causes rotation of lever 18 in the direction of arrow 18B against the applied force of its spring 22. As a result, the lower end 18A of lever 18 is engaged by lever toe 14C when the plunger of solenoid 13 has been activated and retracted so that the arcuate trace of toe 14C upon rotation of lever 18 in the direction of arrow 14D catches lever end 18A and restricts the movement of lever 18 in the direction indicated by arrow 18C. Thus, when lever 17 is in its open position relative to second transport section 31, lever 18 will also be in its open position and held against the applied force of spring 22 so that toe 18A of lever 18 will be rotated in the direction of arrow 18B a sufficient amount to permit the operation of solenoid 13 and the operation of lever 14 to move toe 14C into engagement position against lever end 18A. However, when lever 17 is actuated by solenoid 16 to move extension arm 17C with pressure roller 7A forward into engagement with drive roller 3A, lever 18 will not follow this movement since it is being held in position by lever toe 14C. Thus, at this point in time, second transport section 31 will have its opening/closing mechanism 30 in a closed position while opening/closing mechanism 30' at the third transport section 34 will be in an open position.

Figure 7:
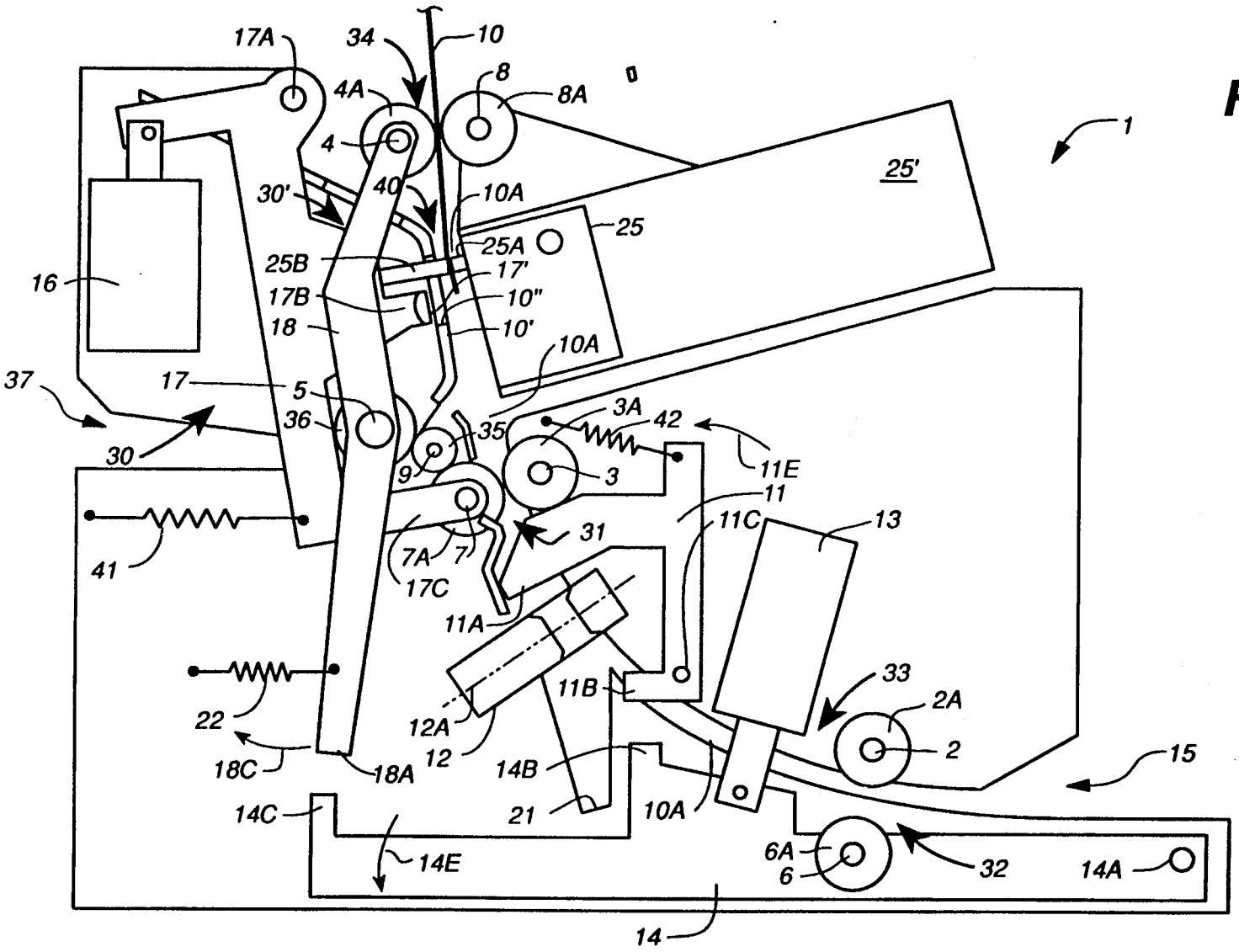
FIG. 7 is a schematic cross sectional elevation of the printer shown in FIG. 1 for the purpose of illustrating a fourth in a series of figures illustrating the operation of the recording medium feed mechanism according to this invention.

When solenoid 13 releases lever 14 by extending its plunger so that toe 14C no longer is engaging end 18A of lever 18, lever 18 will be rotated in the direction of arrow 18C by means of the applied force of spring 22 causing drive roller 4A to engage pressure roller 8A at transport section 34 with medium 10 positioned therebetween. The applied force of spring 41 of lever 17 is made to be greater than the spring force of spring 22 of lever 18, lever 18 would normally follow the rotational bidding of lever 17 due the engagement of contact member 17' on the forward edge of lever 18. However, lever 17 is being held in its extended position by the actuation of solenoid 16 so that lever 18 will rotate in the direction of arrow 18C under the force of its owns spring 22 away from member 17B, as seen in FIG. 7. As a result, the applied force of spring 22 rotates lever 18 in a clockwise direction 18C and places drive roller 4A into engagement with pressure roller 8A to engage and continually feed slip medium 10 along pathway 10A and out of inlet 19.

The basic operation of transport sections 31 and 34 and their respective mechanisms 30 and 30' is as follows. Since the distance between drive roller 2A and drive roller 3A is fixed and the amount of recording medium transported is easily determined by the number of steps motor 1A is rotated, the position of any size length of slip medium 10 being transported along pathway 10A can be easily determined. After a prescribed number of steps of movement of medium 10, it reaches and passes through second transport section 31 and solenoid 16 can be actuated to operate the second transport section opening/closing mechanism 30 to its closed position. Since lever 18 is held by lever 14 from any movement, the third transport section opening/closing mechanism 30' remains in its open position.

At the closing of mechanism 30, also printer section 40 closes with platen 25B passing through opening 10'' and brought into spaced relation relative to printing elements 25A automatically forming the proper printing gap based upon the thickness of medium 10 determined at the second transport section 31. This facilitates good printing quality on medium 10 through proper printing gap adjustment. Recording medium may come in various thickness due to multiple copies for validation purposes, for example, so that automatic print gap adjustment to the particular recording medium being introduced into printer 1 without operator intervention becomes an important feature in a printer capable of handling different sizes and thickness of different types of recording media.

After a prescribed number of steps in the transport of recording medium 10, as detected relative to sensor 12, the leading edge of medium 10 will have progressed passed printer section 40 and into third transport section 34. Solenoid 13 is deactivated to release lever 14 from holding lever 18 so that, concurrently, both the second and third transport sections 31 and 34 will have their opening/closing mechanisms 30 and 30' in their closed positions to concurrently transporting medium through printer section 40. Positive engagement of medium 10 on adjacent sides of printer section 40 ensures good printing quality achieved on the surface of medium 10. Continued progression of the transport of medium 10 and printing of data brings the margin of the trailing edge of medium 10 into printing engagement with printing elements 35A in the print gap permitting with margin printing accomplished since medium 10 is still held for transport by rollers 4A and 8A. Medium transport is terminated by opening opening/closing mechanism 30', which is accomplished by opening opening/closing mechanism 30 via inactivation of solenoid 16 and employment of contact member 17'. Discharge of medium 10 out of printer 1 may be accomplished by termination of operation of transport section 34 after the trailing edge of medium 10 has been discharged from the printer or by termination of operation of transport section 34 when the trailing edge of medium 10 is still within the grip of rollers 4A and 8A and medium 10 is thereafter removed from the roller grip by pulling via an operator's hand.

It should noted from the foregoing description that it only requires the operation of two solenoids 13 and 16 to operate independently of one another in the functioning of three opening and closing of opening/closing mechanisms 33, 30 and 30', respectively, at the three recording medium transport sections 32, 31 and 34.

In the case of prior art transport methods, slip or card medium transport between respective independently driven recording medium transport sections can encounter problems since there would be no drive interrelationship provide between the driving rollers of adjacently disposed transport sections. The transported medium will become slack in regions between adjacently disposed transport sections resulting potentially in a medium jam in the medium pathway 10A requiring opening of printer 1 and the removal of the jam. However, in the case of printer 1 of this invention, when step motor 1A is operated and its rotational force is applied to drive shafts 2–5, all drive shafts 2, 3, 4, and 5 rotate concurrently with the same incremental steps via their associated gear and belt mechanisms, shown in FIG. 2. Therefore, no medium slack can occur in the transport of slip medium 10 in medium pathway 10A. Further, each respective drive shaft 2 and 3 and its corresponding drive roller 2A and 3A cease to be operative on medium 10 after medium 10 has proceeded beyond the respective recording medium transport sections 32 and 31. In the case where medium 10 has not reached respective recording medium transport sections 31 or 34, the opening/closing mechanisms 30 and 30' of these transport sections remain in their opened position so as not to interfere with the transport of medium 10 even though their respective drive rollers are still rotatably stepped by the drive means shown in FIG. 2. Also, since positive medium feeding means are positioned at adjacent sides of printing mechanism 25 at recording medium transport sections 31 and 34, printing from the very top edge of slip medium 10 to the very bottom edge of slip medium 10 can be accurately accomplished without slippage of medium 10 during printing at printing section 40.

Figure 8:
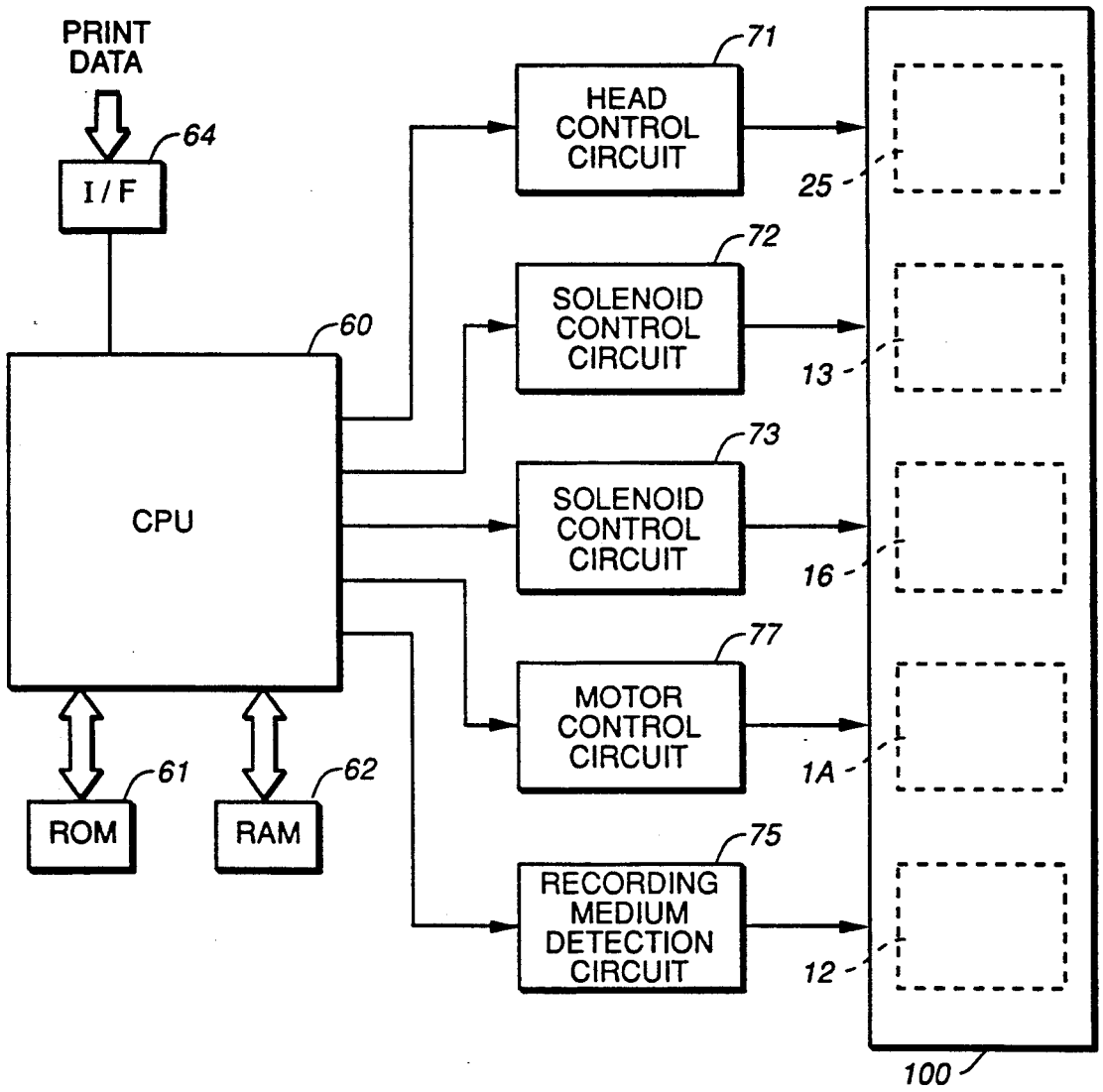
FIG. 8 is a block diagram illustrating the general configuration of the control system for the printer of this invention.

Reference is now made to FIG. 8 which is a block diagram of the control system for the printer of this invention. The different electro-mechanical operating devices involved in the transport and printing of recording medium 10 are indicated in block 100 comprising print head 25; solenoid 13 operative at first recording medium transport section 32 including the first transport opening/closing mechanism 33; solenoid 16 operative at second recording medium transport section 31 including the second and third transport opening/-closing mechanisms 30 and 30'; drive motor 1A serving as a single drive source for the several medium transport sections; and medium sensor 12 to sense the presence and absence of transported recording medium 10. Each of these devices is respectively operated by means of a control circuit, to wit, head control circuit 71 for operation of print head 25; solenoid control circuit 72 for operation of solenoid 13; solenoid control circuit 73 for solenoid 16; motor control circuit 74 for motor 1A; and recording medium detection circuit 75 responsive to recording medium sensor 12. The control system further includes CPU 60, which is operative in conjunction with ROM 61 and RAM 62, to receive print data, via interface 64, for temporarily writing print data into RAM 62 wherein the data is then analyzed by CPU 60. Character font data in ROM 61 is then accessed from ROM 61 corresponding to the analyzed print data in RAM 62 and is, thereafter, sequentially supplied to head control circuit 71 for printing at print head 25 in conjunction with the operation of respective solenoids 13 and 16 and step motor 1A. Medium 10 is transported through printer 1 while printing data on medium 10 and, correspondingly, this transport is carried through the engagement (closing) and disengagement (opening) of the first, second and third opening/closing mechanisms 33, 30 and 30' at respective transport sections 33, 31 and 34 according to information received via sensor 12 indicative of the presence or absence of the recording medium at sensing position 12A. Determination is made through the control system of FIG. 8 by determining the number of predetermined steps necessary to transport recording medium 10 from one transport section to the next sequential transport section to provide for the closing and subsequent opening of one or more of the opening/closing mechanisms 33, 30 and 30'. The method of control of these mechanisms is explained in further detail relative to the flow chart of FIG. 9.

Figure 9:
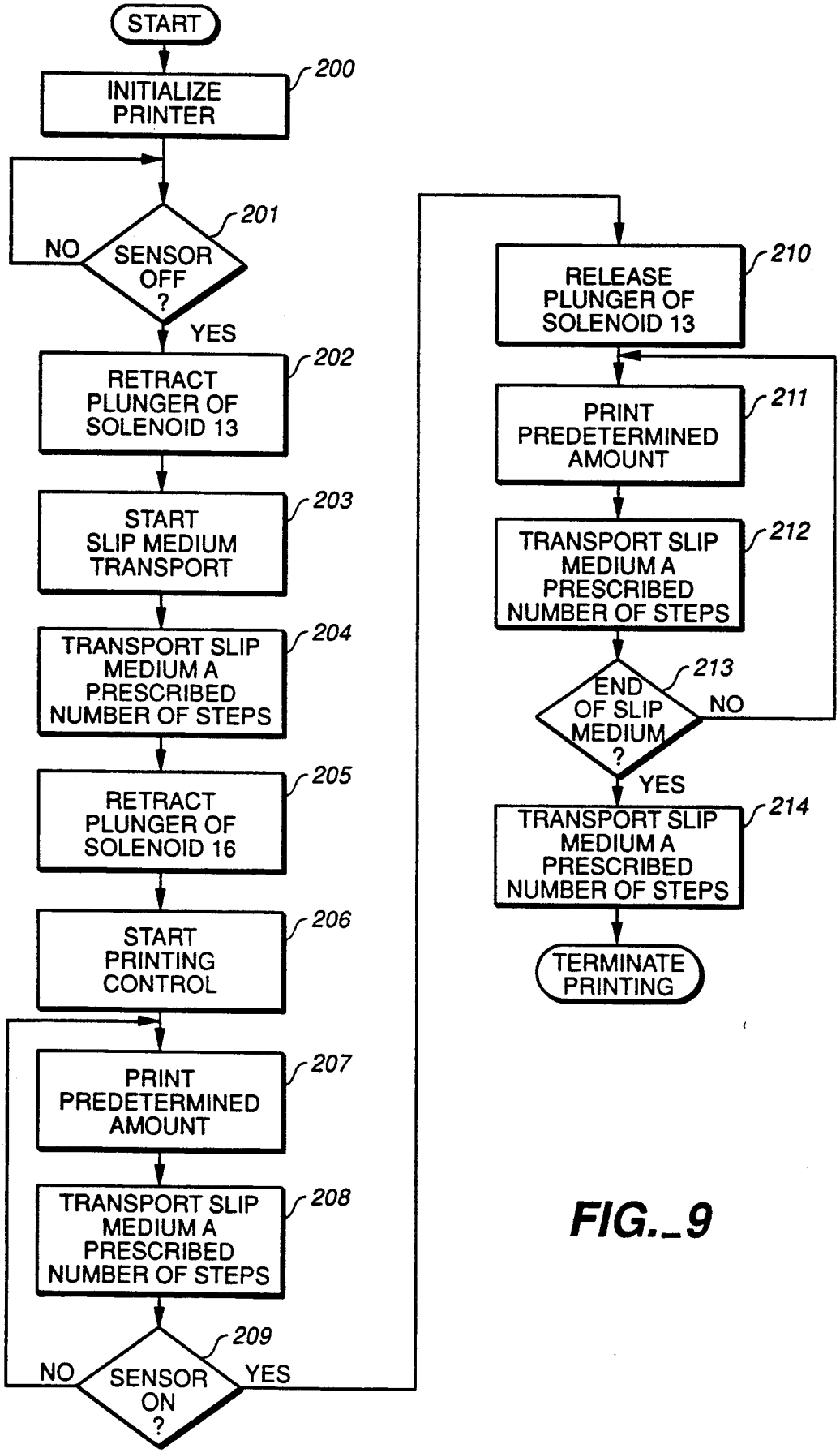
FIG. 9 is a flow chart illustrating a method for controlling the transport of the recording medium in the printer comprising this invention.

Reference is now made to FIG. 9 for the purpose of explaining the operation of the method of controlling printer 1 for printing on a slip medium 10. FIG. 9 illustrates the printing routine for the transport and printing of data on medium 10 via print head 25 in conjunction with the operation of solenoids 13 and 16 and the transport of medium 10 via step motor 1A, with the use of medium detection activity made by sensor 12.

Upon receipt of a print command, print data is written into RAM 62. At this point, the start of the printer operation commences with printer being initialized (Step 200) wherein solenoids 13 and 16 are placed in their inactivated state with their plungers extended so that the first, second and third opening/closing mechanisms 33, 30 and 30' at all three transport sections 32, 31, and 34 are in their open positions rendering the recording medium transport pathway 10A free and open. Next, the level of sensor 12 is checked by CPU 60 to confirm that the sensor beam is unbroken, i.e., is ON. With print data already processed into font data for printing, CPU 60 awaits the detection of a slip recording medium 10 via sensor 12. The operator inserts slip medium 10 into pathway 10A until it is stopped by toe 11A of stop member 11. At this time, the leading edge of medium 10 has already passed through sensor 12 so that the beam has been broken at position 12A and, therefore, detection circuit 75 determines that sensor 12 is in an OFF state (Step 201). CPU 60 then directs solenoid control circuit 72 to set the plunger of solenoid 13, i.e., place it in its retracted state (Step 202). This removes stop member toe 11A from pathway 10A, and concurrently engages medium 10 between rollers 2A and 6A. At this point, the transport of medium 10 in pathway 10A is undertaken, as indicated in Step 203. When medium 10 has been transported a prescribed amount (Step 204), i.e., a predetermined number of steps determined by counting from its initial inserted position as engaged against stop member toe 11A. This is indicative that medium 10 has passed through second transport means 31 with its leading edge arriving at printer section 40. AT this time, solenoid control circuit 73 is operated to set the plunger of solenoid 16, i.e., place it in its retracted state (Step 205). As a result, medium 10 is also engaged by rollers 3A and 7A at second transport section 31. The number of predetermined steps to be accomplished by motor 1A may be provided by count down via a counter relative to CPU 60 according to a total number previously stored in ROM 61, which is representative of the distance between the position at stop member toe 11A and the position of printing elements 25A in printer section 40.

At this time, printing of printing is initiated via printing elements 25A starting on the portion of medium 10 immediately adjacent to its leading edge (Step 206).

At this point, it should be noted that slip medium 10 is being held by both engaged roller pairs 2A, 6A and 3A, 7A of the respective first and second opening/closing mechanisms 33 and 30. As a result, good control is maintained over the beginning of transport and aligned feed of medium 10 through printer section 40 with improved enablement of printing data very close to the leading edge of medium 10. The printing of data on medium 10 proceeds with the stepped operation of the medium through pathway 10A via two spatially disposed transport sections 33 and 31 (Steps 207 and 208) until detection circuit 75 determines that sensor 12 is ON (Step 209), i.e., there is no longer the detected presence of slip medium 10 at sensor 12 and the trailing edge thereof has passed position 12A. Also, at this time, the leading edge of slip medium 10 has also passed through the third transport section 34 between rollers 4A and 8A. At this point in time, solenoid control circuit 72 is directed to release the plunger of solenoid 13 (Step 210), i.e., solenoid 13 is deactivated, causing the opening of first transport section opening/closing mechanism 33. As previously noted in conjunction with FIG. 7, the extension or dropping of lever 14 causes toe 14B to disengage from the end 18A of lever 18 as well as permits toe 11A of stop member 11 to again obstruct pathway 10A in preparation of the next insertion of a slip medium in inlet 15. Concurrently, the release of lever 18 permits the operation of mechanism 30', permitting the engagement of rollers 4A and 8A at the third transport section 34 with forward end of recording medium 10 positioned therebetween for its continued, uninterrupted transport.

At this point in time, it should be noted that slip medium 10 is now being held by both engaged roller pairs 3A, 7A and 4A, 8A of the respective second and third opening/closing mechanisms 30 and 30'. As a result, good control is maintained over the continued transport and aligned feed of medium 10 through printer section 40 with the printing of data. In this manner, the previously established alignment of medium 10 in pathway 10A established by the first and second transport sections 32 and 31 is accurately carried over to or handed off to the third transport section 34. Printing of a predetermined amount of data on medium 10 continues (Step 211) as medium 10 is transported past print head 25 (Step 212) until it is determined that the predetermined amount of printing of all print data has been accomplished (Steps 211, 212, 213 and "NO") or a determination has been made by a further counter down by a counter relative to CPU 60 in comparison with a number in stored in ROM 60 that a prescribed number of steps has been accomplished indicative that the trailing edge of medium 10 has passed from printer section 40, at which time no further printing action can be accomplished (Step 213 and "YES"). Lastly, slip medium 10 is transported a further prescribed number of steps, as determined by further count down by a counter relative to CPU 60 in comparison with a number in stored in ROM 60, sufficient to eject medium 10 from inlet/outlet 19 and, as a result, the printing routine is terminated.

As described relative to the foregoing explanation relative to FIG. 9, it can be seen that slip medium 10 is guided through pathway 10A by the first recording medium transport section 33 and fed through printing section 40 by both the second recording medium transport section 31 and the third recording medium transport section 34 to provide for effective printing from the leading edge to the trailing edge of recording medium 10. Thus, it is effective with the employment of a printer feed mechanism having triple transport sections to print from the leading edge of the slip medium to the trailing edge of the slip medium without leaving any substantial margin thereby accommodating nonstandard as well as standardized types of recording mediums, such as, different lengths of cash register slip media. Thus, the single printer of this invention can accommodate different lengths of slip medium by merely programming different total medium step numbers in ROM 61 according to the given length of the medium to be employed. Alternatively, a field program logic array device may be employed instead of utilizing ROM 61 for storage of count down data, which programmable device can be programmed according to the needs relative to different lengths of different types of slip media.

Also, by means of a more compact printer utilizing a single motor source with multiple drive or transport means that provide opening/closing mechanisms can be selectively placed in their open and closed positions along the recording medium pathway, it is possible to provide for a way to transport through the printer several different kinds of print media, and in the case of slip or card type medium, to closely control the passage of the medium adjacent to the print head wherein printing can be extended to substantially utilize the entire medium surface for printing data. Furthermore, because of the simplification of the number of parts that must be controlled, i.e., lever 18 being operated relative to the operation of levers 14 and 17, and the continuous stepped operation of all drive rollers 2A, 3A and 8A from a single drive means will not interfere with the transport of the medium due to ability to be selectively engaged and disengaged these drive rollers from transport of the medium even though these disengaged drive rollers may be continued in step drive rotation. Lastly, the printer of this invention is highly ideal for connecting a plurality of such printers to a single host computer wherein each printer independently functions as a POS terminal.

While the invention has been described in conjunction with several specific embodiments, it is evident to those skilled in the art that many further alternatives, modifications and variations will be apparent in light of the forgoing description. Thus, the invention described herein is intended to embrace at such alternatives, modifications, applications and variations as fall within the spirit and scope of the appended claims.

What is claimed is:

1. A printer having a printer section and means for transport of at least two different types of media from two different inlets into the printer for transport along a pathway and through an entrance to the printer section and exit from the printer section to an outlet, comprising a first recording medium transport section disposed in said pathway adjacent to one of said inlets and comprising a first drive roller and a first corresponding pressure roller, a second recording medium transport section disposed in said pathway immediately prior to the entrance of said printer section and comprising a second drive roller and a second corresponding pressure roller, a third recording medium transport section disposed in said pathway immediately after the exit of said printer section and comprising a third drive roller and a third corresponding pressure roller, said first, second and third drive rollers being driven in common from a single power source, a first opening/closing mechanism in operative engagement with said first transport section for selectively opening and closing said first drive and pressure roller for engagement of the recording medium to transport the recording medium through said first transport section, a second opening/closing mechanism in operative engagement with said second transport section for selectively opening and closing said second drive and pressure rollers for engagement of the recording medium to transport the recording medium through said second transport section, a third opening/closing mechanism arranged at and in operative engagement with said third transport section for selectively opening and closing said third drive and pressure rollers for engagement of the recording medium to transport the recording medium through said third transport section, one of said second and third transport section providing for continuous engagement with said recording medium adjacent both the entrance and exit to said printer section to permit the accurate printing of data in the margins at the leading edge to the trailing edge of recording medium and said first opening/closing mechanism being in operative engagement with said third opening/closing mechanism such that said third opening/closing mechanism closes to engage the recording medium when said first opening/closing mechanism is opened to disengage with the recording medium.

2. The printer of claim 1 further comprising blocking means positioned along said pathway between said first and second transport sections to engage the leading edge of the recording medium inserted into said inlet, and control means coupled to operate said first, second and third transport sections and said first, second and third opening/closing mechanisms by determining the location of said trailing and leading edges of said recording medium based upon counting of a number of steps in accordance with stepped transport of the recording medium beginning from its engaged position with said blocking means.

3. The printer of claim 1 wherein engagement of said third opening/closing mechanism by said second opening/closing mechanism when the former is placed in its opened position permits engagement by said first opening/closing mechanism of said third opening/closing mechanism to maintain the latter in its opened position regardless of subsequent positioning of said second opening/closing mechanism, and wherein said printer further comprises biasing means for placing said third opening/closing mechanism in its closed position upon release of said first opening/closing mechanism until said second opening/closing mechanism is placed again in its open position.

4. A printer having a printer section and means for transport of a slip or sheet like recording medium from an inlet along a pathway and through an entrance to the printer section and exit from the printer section to an outlet, comprising:

a first recording medium transport section disposed in said pathway adjacent to said inlet and comprising a first drive roller and a first corresponding pressure roller, a second recording medium transport section disposed in said pathway immediately prior to the entrance of said printer section and comprising a second drive roller and a second corresponding pressure roller, a third recording medium transport section disposed in said pathway immediately after the exit of said printer section and comprising a third drive roller and a third corresponding pressure roller, said first, second and third drive rollers being driven in common from a single power source and corresponding pressure rollers, a first opening/closing mechanism in operative engagement with said first transport section for selectively opening and closing said first drive and pressure rollers for engagement of the recording medium to transport the recording medium through said first transport section, a second opening/closing mechanism in operative engagement with said second transport section for selectively opening and closing said second drive and pressure rollers engagement of the recording medium to transport the recording medium through said second transport section, a third opening/closing mechanism in operative engagement with said third transport section for selectively opening and closing said third drive and pressure rollers engagement of the recording medium via said third drive and pressure rollers to transport the recording medium through said third transport section, blocking means positioned along said pathway between said first and second transport sections to engage the leading edge of the recording medium inserted into said inlet, detection means positioned along said pathway between said first transport section and said blocking means, one of said second and third transport means providing for continuous engagement with said recording medium adjacent to said printer section entrance and exit to permit the accurate printing of data in the margins at the leading edge to the trailing edge of recording medium, said first opening/closing mechanism being in operative engagement with said third opening/closing mechanism such that said third opening/closing mechanism closes to engage the recording medium when said first opening/closing mechanism is opened to disengage with the recording medium.

5. The printer of claim 4 further comprising control means coupled to operate said first, second and third transport sections and said first, second and third opening/closing mechanisms by determining the location of said trailing and leading edges of said recording medium based upon counting a number of steps in accordance with stepped transport of the recording medium beginning from its engaged position with said blocking means.

6. The printer of claim 4 wherein engagement of said third opening/closing mechanism by said second opening/closing mechanism when the former is placed in its opened position permits engagement by said first opening/closing mechanism of said third opening/closing mechanism to maintain the latter in its opened position regardless of subsequent positioning of said second opening/closing mechanism, and wherein said printer further comprises biasing means for placing said third opening/closing mechanism in its closed position upon release of said first opening/closing mechanism until said second opening/closing mechanism is placed again in its open position.

7. A printer having a printer section having a print head with printing elements aligned relative to an opposing platen adjustable in spacing relative to said printing elements to form a print gap of a selected gap size and means for transport of a slip or sheet like recording medium from an inlet along a pathway and through an entrance to the printer section and exit from the printer section to an outlet, comprising:

a first recording medium transport section disposed in said pathway adjacent to said inlet and having a first opening and closing mechanism for at least one of engaging said first transport section with and disengaging said first transport section from a recording medium positioned at said transport section, a second recording medium transport section disposed in said pathway immediately prior to the entrance of said printer section and having a second opening and closing mechanism for at least one of engaging said second transport section with and disengaging said second transport section from a recording medium when its leading edge is positioned at said transport section, said second opening and closing mechanism also supporting said platen for adjusting said print gap upon engagement of the recording medium at said second transport section, a third recording medium transport section disposed in said pathway immediately after the exit of said printer section and having a third opening and closing mechanism for at least one of engaging said third transport section with and disengaging said third transport section from a recording medium when its leading edge is positioned at said transport section, blocking means positioned along said pathway between said first and second transport sections to engage the leading edge of the recording medium inserted into said inlet, detection means positioned along said pathway between said first transport section and said blocking means, first power means for operating said first opening/closing mechanism to place said first opening/closing mechanism in either its open or closed position for respectively engaging said first transport section with or disengaging said first transport section from the recording medium, second power means for operating said second opening/closing mechanism to place said second opening/closing mechanism in either its open or closed position for, respectively, engaging said second transport section with or disengaging said second transport section from the recording medium and concurrently positioning said platen to form or not form said print gap, wherein said first power means is operative on said first opening/closing mechanism to place said mechanism in its closed position and remove said blocking means from said pathway when the recording medium is detected by said detection means, and wherein said first power means is operative on said third opening/closing mechanism to place said mechanism in its closed position whereby said third transport section is engaged to the recording medium if said second power means has previously been activated to place said second opening/closing mechanism in its closed position.

8. The printer of claim 7 wherein said first power means is operative on said third opening/closing mechanism to hold said third opening/closing mechanism in its open position if said second power means has previously been inactivated to place said second opening/closing mechanism in its open position.

9. A printer having a printer section having a print head and means for transport of a slip or sheet like recording medium from an inlet along a pathway and through an entrance to the printer section and exit from the printer section to an outlet, comprising:

a first recording medium transport section disposed in said pathway adjacent to said inlet and having a first opening/closing mechanism for at least one of closing said first transport section to engage with a recording medium in the pathway and opening said first transport section to disengage from a recording medium present in the pathway, a second recording medium transport section disposed in said pathway immediately prior to the entrance of said printer section and having a second opening/closing mechanism for at least one of closing said second transport section to engage with a recording medium in the pathway and opening to disengage from a recording medium present in the pathway, a third recording medium transport section disposed in said pathway immediately after the exit of said printer section and having a third opening/closing mechanism for at least one of closing said third transport section to engage a recording medium in the pathway and opening said third transport section to disengage from a recording medium present in the pathway, linking means for releasably interconnecting said first opening/closing mechanism with said third opening/closing mechanism, blocking means positioned along said pathway between said first and second transport sections for engaging the leading edge of the recording medium inserted into said inlet, detection means positioned along said pathway between said first transport section and said blocking means, first control means for closing said first opening/closing mechanism and concurrently moving said blocking means from the pathway when said detection means initially determines the presence of a recording medium in said pathway thereby facilitating transfer of the recording medium along the pathway by said first transport means, second control means for closing said second opening/closing mechanism when the recording medium has been transported along the pathway a predetermined amount based from the initial determination of the presence of the recording medium by said detection means and initiation of printing at said printer section on the recording medium starting at its leading edge, said first control means for opening said first opening/closing mechanism, concurrently moving said blocking means into the pathway and closing said third opening/closing mechanism via said linking means when the recording medium has been transported along the pathway a further predetermined amount based from the initial determination of the presence of the recording medium by said detection means and completing the printing at said printer section on the recording medium terminating at its trailing edge.

10. A method for controlling the transport of a recording medium by means of first, second and third transport sections positioned along a pathway in a printer, the pathway being defined starting at a medium inlet, thence through an entrance to a printer section for printing on its printing surface and exit from the printer section to an outlet, comprising the steps of providing the first transport section adjacent to the medium inlet having a first opening/closing mechanism for opening or closing the first transport section to respectively inhibit or permit the transport of the medium in the first transport section, providing the second transport section at the entrance to the printer section having a second opening/closing mechanism for opening or closing the second transport section to respectively inhibit or permit the transport of the medium in the second transport section, providing the third transport section at the exit of the printer section having a third opening/closing mechanism for opening or closing the third transport section to respectively inhibit or permit the transport of the medium in the third transport section, the third opening/closing mechanism being operatively engaged to the first opening/closing mechanism, detecting the insertion of the medium in the printer when the leading edge of the medium is inserted into the printer inlet to a predetermined point along the pathway, engaging the medium by closing the first opening/-closing mechanism and transporting the recording medium along the pathway, determining whether or not the medium has passed a point wherein the medium can be engaged by the second transport section, engaging the medium by closing the second opening/closing mechanism and transporting the recording medium along the pathway via the first and second transport sections, determining whether or not the recording medium has passed a point wherein the medium can be engaged by the third transport section, engaging the medium by closing the third opening/-closing mechanism when the first opening/closing mechanism, which is operatively engaged to the third opening/closing mechanism, is opened and transporting the recording medium along the pathway via the third transport.

* * * * *